US012653318B2

(12) United States Patent
Burkhalter

(10) Patent No.: US 12,653,318 B2
(45) Date of Patent: Jun. 16, 2026

(54) SUPPORT CUSHION HAVING MATTRESS DEPRESSION STRUCTURE

(71) Applicant: John Burkhalter, Gainesville, GA (US)

(72) Inventor: John Burkhalter, Gainesville, GA (US)

( * ) Notice: Subject to any disclaimer, the term of this patent is extended or adjusted under 35 U.S.C. 154(b) by 4 days.

(21) Appl. No.: 18/673,727

(22) Filed: May 24, 2024

(65) Prior Publication Data

US 2024/0389759 A1 Nov. 28, 2024

Related U.S. Application Data

(60) Provisional application No. 63/527,117, filed on Jul. 17, 2023, provisional application No. 63/504,491, filed on May 26, 2023.

(51) Int. Cl.
*A47C 20/02* (2006.01)

(52) U.S. Cl.
CPC ..... *A47C 20/026* (2013.01)

(58) Field of Classification Search
CPC ..... A47C 20/026; A47C 16/00; A47C 7/383; A47C 20/027; A47C 20/02; A47C 27/00; A47C 20/00; A47C 20/021; A47C 20/023; A47C 20/047; A47C 7/38; A61G 2200/325; A61G 7/07; A61G 13/121; A61G 7/072; A61G 13/009; A61G 13/12; A61G 7/075; A61G 13/122; A61G 7/065; A61G 13/101; A61G 13/1215; A61G 13/1235; A61G 13/1265; A61G 15/12; A61G 2200/12; A61G 7/05723; A61G 7/1021; A47G 9/1054; A47G 9/10; A47G 9/1027; A47G 2009/003; A47G 2009/1018; A47G 9/1009; A47G 9/1081; B60N 2/882; B60N 3/001; A61F 5/56; A61H 37/00; A61H 2205/022
USPC ... 5/638, 640, 632, 636, 643, 657, 189, 622, 5/630, 639, 644, 652, 659; 248/118, 248/118.3, 125.8, 220.21; 297/391, 392
See application file for complete search history.

(56) References Cited

U.S. PATENT DOCUMENTS

| | | | | |
|---|---|---|---|---|
| 2,107,962 A | | 2/1938 | Sheasby | |
| 2,551,727 A | | 5/1951 | Costello | |
| 2,634,435 A | | 4/1953 | Budd | |
| 2,688,142 A | | 9/1954 | Jensen | |
| 3,114,527 A | * | 12/1963 | Demarest | A47C 20/026 5/643 |
| 5,033,138 A | | 7/1991 | Hong | |
| 5,044,026 A | | 9/1991 | Matthews | |
| 6,581,226 B1 | | 6/2003 | Brustein | |

(Continued)

FOREIGN PATENT DOCUMENTS

| | | | |
|---|---|---|---|
| CN | 206979686 U | * | 2/2018 |
| GB | 2323277 | | 9/1998 |

*Primary Examiner* — Madison Matthews
(74) *Attorney, Agent, or Firm* — Fox Rothschild LLP

(57) ABSTRACT

A personal support apparatus for use when resting on a sleeping surface in certain positions, particularly prone or face-down positions and side-resting positions. The apparatus comprises a support cushion and a bracket member with a depressor tongue that forms a depression or cavity in the sleeping surface when the user is resting on the cushion, helping to increase airflow to the user and facilitate breathing, all while reducing strain, increasing comfort, and optimizing rest. Alternate embodiments include multiple support cushions and a raised cradle member for supporting a user's forehead or other body parts.

14 Claims, 5 Drawing Sheets

(56) References Cited

U.S. PATENT DOCUMENTS

| | | | | |
|---|---|---|---|---|
| 7,673,356 | B1 | 3/2010 | Conyers | |
| 9,398,992 | B1 * | 7/2016 | Jansen | A47C 20/026 |
| 10,492,617 | B1 * | 12/2019 | Macedo | A47C 20/02 |
| 2005/0177946 | A1 | 8/2005 | Riley | |
| 2012/0304387 | A1 * | 12/2012 | Crompton | A47C 20/026 5/632 |
| 2013/0305455 | A1 * | 11/2013 | Davis | A61G 13/1215 5/639 |
| 2018/0042409 | A1 | 2/2018 | Johnson | |
| 2022/0218129 | A1 | 7/2022 | Ansted | |

* cited by examiner

SUPPORT CUSHION HAVING MATTRESS DEPRESSION STRUCTURE

CROSS REFERENCE TO RELATED APPLICATIONS

The present application is a non-provisional of U.S. Provisional Application Ser. No. 63/504,491 entitled Prone Pads and Methods of Use, filed on May 26, 2023, and 63/527,117 entitled Prone Pads and Methods of Use filed on Jul. 17, 2023. All of the foregoing applications are hereby incorporated by reference in their entireties.

BACKGROUND/SUMMARY

Background of the Invention

The invention relates to a personal support apparatus for use when resting on a sleeping surface in certain positions, particularly prone or face-down positions and side-resting positions. The apparatus involves use of a depressor structure with one or more protruding portions that forms one or more depressions or cavities in the sleeping surface, helping to increase airflow to the user and facilitate breathing, all while reducing strain and jaw pressure, increasing comfort, and optimizing rest.

Healthy resting positions are an important concern given that certain resting positions, such as face-down positions (also called prone positions) and side-resting positions (also called lateral recumbent positions), can restrict optimal breathing, increase strain on muscles and joints, and reduce overall comfort and quality of a person's rest. These positions may be necessary or preferred for medical patients recovering from surgery or illness or managing a chronic medical condition, but may nevertheless cause undesirable limitations on the quality of rest and comfort.

Given the importance of rest, a need exists to provide a support apparatus for use when resting that reduces the negative effects and limitations caused by these positions. Many people resting in these positions find that their breathing and airflow is restricted when their faces are pressed against a mattress or pillow. These same individuals may also experience breathing difficulty and discomfort due to the shoulder position and poor posture that results from these positions, impeding the ability to experience deep breathing from the "closing" of the chest and lungs. In addition, these positions can cause the jaw, mouth, and nose to press against the pillow or mattress, further restricting breathing passageways, and can also cause the neck and/or jaw to be twisted into an unnatural and eventually painful position.

Prior attempts to provide support devices or pillows with increased airflow for the user include UK published application GB2323277A (Wood) disclosing a pillow for supporting the head of a user which has a body of compliant material having a head receiving opening and at least one airway to the head receiving opening, where the head receiving opening passes completely through the pillow so that the pillow comprises an annulus of compliant material and is defined by a peripheral surface which, with the user lying face down, supports the user's head with his face away from the underlying surface.

U.S. Pat. No. 2,107,962 (Sheasby) discloses a pillow comprising a supporting frame, a second frame adjustably connected to the first frame, a plurality of radially arranged resilient elements connected to the second frame, a ring-like member supported by the resilient elements, a pillow having a nose and mouth opening supported by the resilient elements with the opening aligning with the ring-like member, and a means for securing the pillow to the ring-like member.

U.S. Pat. No. 6,230,350 (Goldstein) discusses a support pad or pillow for supporting the head in a face down, prone position, the pad having a face recess providing a breathing void and at least one air flow conduit extending from the face recess through the body of the support pad to the exterior to provide fresh ambient air to the face recess area, where the air flow conduit contains rigid support means to prevent the conduit from being compressed, restricted or closed by the weight of the user's head, and a filter to block particulate matter from entering the air flow conduit.

U.S. Pat. No. 2,551,727 (Costello) shows a face rest comprising an elevated supporting frame shaped partially to encircle a face rest area, with arcuate supporting members or rails and a fabric face support secured to the frame using a draw string arrangement.

U.S. published application No. 20050177946A1 (Riley) refers to a head support device that includes a padded member having a generally horse-shoe shape with a top, arcuate sides spaced apart ends, a first inner side wall and a second inner side wall, a first region for supporting the user's face in the frontal sinus area, a second region adjacent to the eye socket and check area for supporting the user's face area, and a third region for support along the sides of the user's mandible.

U.S. published application No. 20180042409A1 (Johnson) discloses a pillow configured to receive a person in a face down position, the pillow including a receiving portion and one or more pathways.

U.S. Pat. No. 5,044,026 (Matthews) discloses a face pillow that consists basically of a pair of horizontally disposed cylinders of resilient material placed side-by-side on a bed or other flat surface, and a pair of straps extending around the two cylinders so that, in use position, these straps determine the width of a gap between the cylinders.

US20220218129A1 (Ansted) shows a pillow consisting of two generally cylindrical shaped sleeves forming soft cushions connected along their longitudinal axes with a flexible linking member to provide an adjustable channel for a side or stomach sleeping user to more easily draw breath through her mouth or nose.

U.S. Pat. No. 2,634,435 (Budd) refers to improvements in "facial hammocks," that is, devices for supporting the head of a person after a facial massage, or the application of creams, lotions, and the like, while U.S. Pat. No. 2,688,142 (Jensen) shows a headrest with a rigid portable base plate along with cushion elements and bar-like connecting members being in the nature of connected inflatable shells.

Each of the above documents are hereby incorporated herein by reference, in their entireties.

However, in spite of the prior efforts, a convenient, comfortable, and user-friendly device that frees up airspace for someone resting in a prone or lateral recumbent position has not been provided. Thus, a pillow or cushion that allows the user to rest more naturally in the prone and lateral recumbent positions, all while providing greater airspace and air circulation, deserves much consideration.

SUMMARY OF THE INVENTION

The present invention is directed to a device that provides an inexpensive, user-friendly, and simple design that is easily manufactured and used, providing a person resting on a sleeping surface in the prone or lateral recumbent position a support apparatus that assists in forming a cavity or pocket between the person's nose, mouth and/or jaw and the sleeping surface, increasing airflow and comfort and decreasing pain associated with these resting positions. The apparatus further provides support for the person's shoulders and helps to "open" the chest cavity and expand the lungs for improved breathing.

The apparatus, in one preferred embodiment, comprises a support cushion and a depressor structure (also referred to herein as a "depressor tongue" or a "depressor tongue structure") that protrudes from the support cushion at a downward angle relative to the sleeping surface when the user is resting on the support cushion on the sleeping surface in a prone or lateral recumbent position. The depressor structure compresses the sleeping surface to define a cavity in the sleeping surface. For example, in a preferred embodiment, if the user places the support cushion under the user's shoulder or other parts of the upper body near to and/or including the head while resting in the prone position, the user's weight will press down on the support cushion, thereby pushing the depressor structure into the sleeping surface and forming one or more cavities that frees up space around the user's mouth, nose and jaw to improve air circulation and breathing, also resulting in less pressure on the user's jaw, mouth, and nose. By using the apparatus in this manner, the user's shoulder will be raised, which, along with the cavity created by the depressor structure, allows the neck to rotate into a more natural position, alleviating some of the strain and pain of the twisted cervical angle common in these resting positions. The apparatus may also be symmetrical in design allowing for a single apparatus to be used under either shoulder at different times during use.

In one or more alternative embodiments, the depressor structure can be removably attached to the support cushion. For example, the depressor structure could have on one end a bracket or cradle portion into which the support cushion is inserted, and on the other end a protruding portion that pushes down on the sleeping surface when the user is resting on the support cushion. In another preferred embodiment, the depressor structure can be configured to telescope or fold up for easier storage, or can be removable and interchanged with other protruding portions of different shapes and sizes. In yet another embodiment, the apparatus can include a pillowcase-like cover, including one fitted to cover the entire apparatus or one with an aperture through which the protruding portion of the depressor structure can extend. In yet another preferred embodiment, the depressor structure includes one or more downward protruding legs that create a larger or separate cavity in the sleep surface to reduce or eliminate pressure on the jaws and/or eyes.

In an alternate embodiment, the apparatus can contain two support cushions, each having a depressor tongue extending therefrom and connected to each other, with a headrest placed at their junction. In this embodiment, the depressor tongues initially protrude from each support cushion at a downward angle relative to the sleeping surface when the user is resting on the support cushion on the sleeping surface in a prone position, but then are extended or curved upward to form a junction where a headrest is placed. In this embodiment, the user rests each of the user's shoulders on each of the support cushion and rests the user's forehead on the headrest, the weight of which causes the protruding portions of the depressor tongues to press down on the sleeping surface, forming a cavity that frees up airspace and breathing room for the user.

Another embodiment of the two-support cushion apparatus includes a depressor tongue having a cradle attached to one end thereof, and a support bar that is attached to the other end of the depressor structure. Two support cushions are attached to the support bar, so that one support cushion is attached at each end of the support bar. In this embodiment, the depressor tongue intersects the support bar in a generally central portion thereof, forming a T-shaped configuration.

In yet another embodiment, the apparatus can contain one or two support cushions, attached to a connecting support depressor structure of one or more pieces extending therefrom, initially at a downward angle relative to the sleeping surface when the user is resting on the support cushions on the sleeping surface in a prone position or lateral recumbent position. The extending portion of the depressor structure then curves upward or outward and is attached to a cradle for receiving a portion of the user's body, such as the head, an arm or wrist. The extending portion of the depressor structure may be free floating or fixed or adjustable using gear-like teeth or other mechanisms to change the angle of the depressor. The weight of the user's body resting on the support cushion as well as the weight of the head, arm or wrist on the cradle causes the extending portion of the depressor structure to press down on the sleeping surface, forming a cavity that frees up airspace and breathing room for the user. Airflow may also be augmented with an attachable or adjacent mini-fan.

Accordingly, an object of the present invention is to provide a personal support apparatus for use when resting on a sleeping surface in a prone, lateral recumbent, or similar position that increases airflow and facilitates breathing, reduces cervical neck strain and pain, reduces pressure on the jaw, and provides additional shoulder support.

Another object of the present invention is to provide a personal support apparatus that improves the comfort, rest, and breathing for patients with conditions requiring them to rest on their stomachs or sides, and for those who benefit from sleeping in these positions or who may naturally sleep in such positions.

While one object of the present invention is to assist with improved breathing for those who rest in these positions, there could be other applications for the present invention where a person resting on a sleeping surface may benefit from a cavities or pockets being created between the person's body and the bedding, such as to attach or place medical equipment, heating or cooling devices, or other therapeutic devices.

DESCRIPTION OF THE DRAWINGS

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
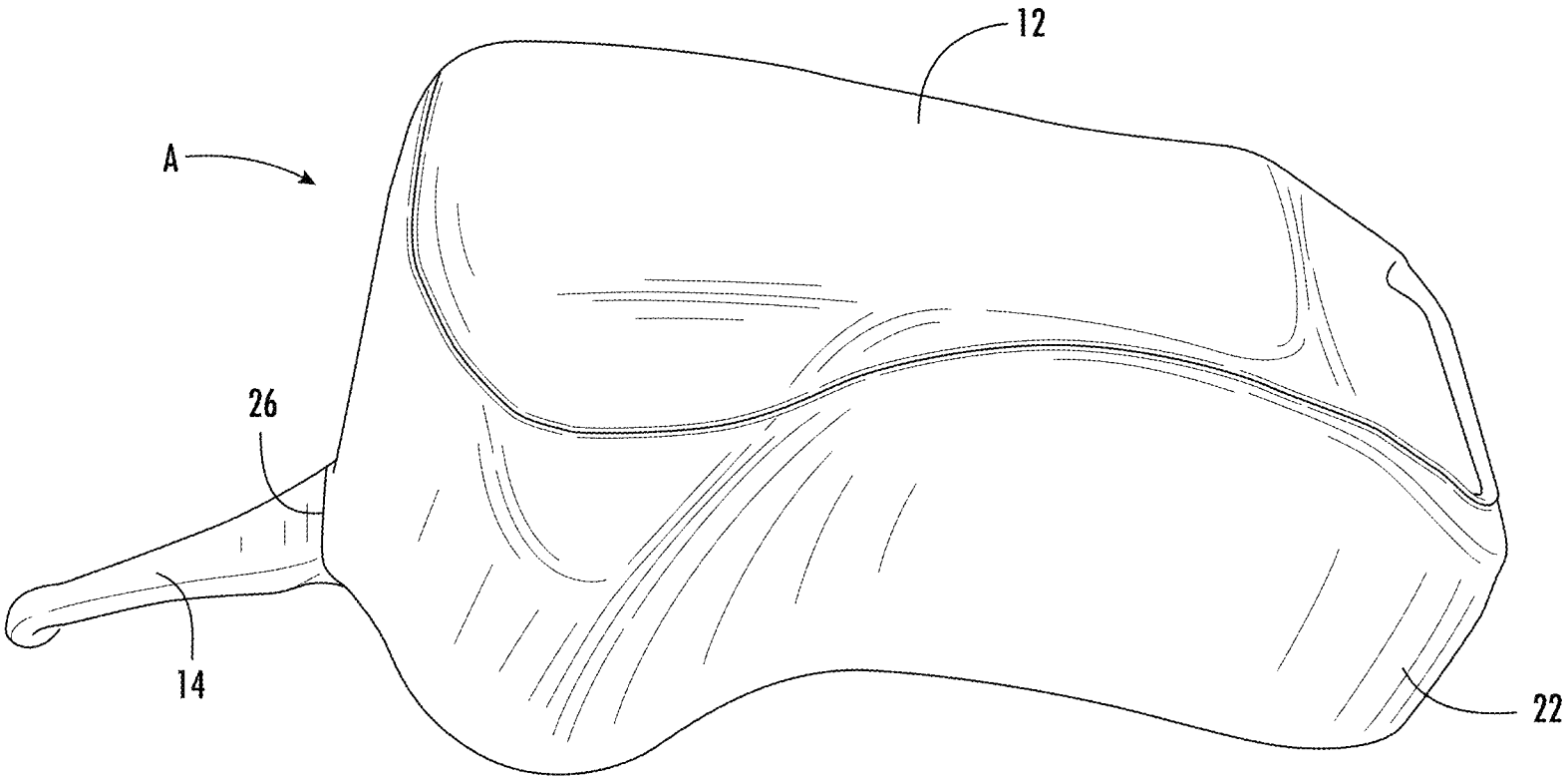
FIG. 1 is an elevated perspective view of one embodiment of a personal support apparatus where the support cushion is connected to the depressor tongue and the personal support apparatus is in a fitted cover.

Referring now to the drawings, the invention will be described in more detail.

As can best be seen in FIGS. 1-6, a personal support apparatus, generally designated as A, is provided for use when resting on a sleeping surface 10 and comprises at least one support cushion 12 and a generally rigid bracket member 20 that includes a depressor tongue structure 14 that extends at a downward angle relative to the sleeping surface 10, wherein the depressor tongue structure 14 compresses the sleeping surface 10 to define a cavity 18 in the sleeping surface 10 when the user is resting on the support cushion 12. The cavity 18 is formed when the user rests in a prone or lateral recumbent position on the support cushion 12, as the weight of the user pressing on the support cushion 12 causes the depressor tongue structure 14 to indent or compress the sleeping surface 10, thereby increasing airflow to the user and also placing the user in a more favorable and comfortable resting position.

The support cushion 12 may be any desired shape or size and of any material commonly used in cushions. In a preferred embodiment illustrated by FIGS. 1-3, the support cushion 12 may be made of hypoallergenic foam and contoured into an hourglass shape with inward curved sidewalls and longer in one dimension than another. In this embodiment, the user's body can more easily fit against the support cushion 12, whether the user is in a prone position or a lateral recumbent position, with the support cushion 12 placed in the most desirable location to maximize the user's comfort.

Figure 2:
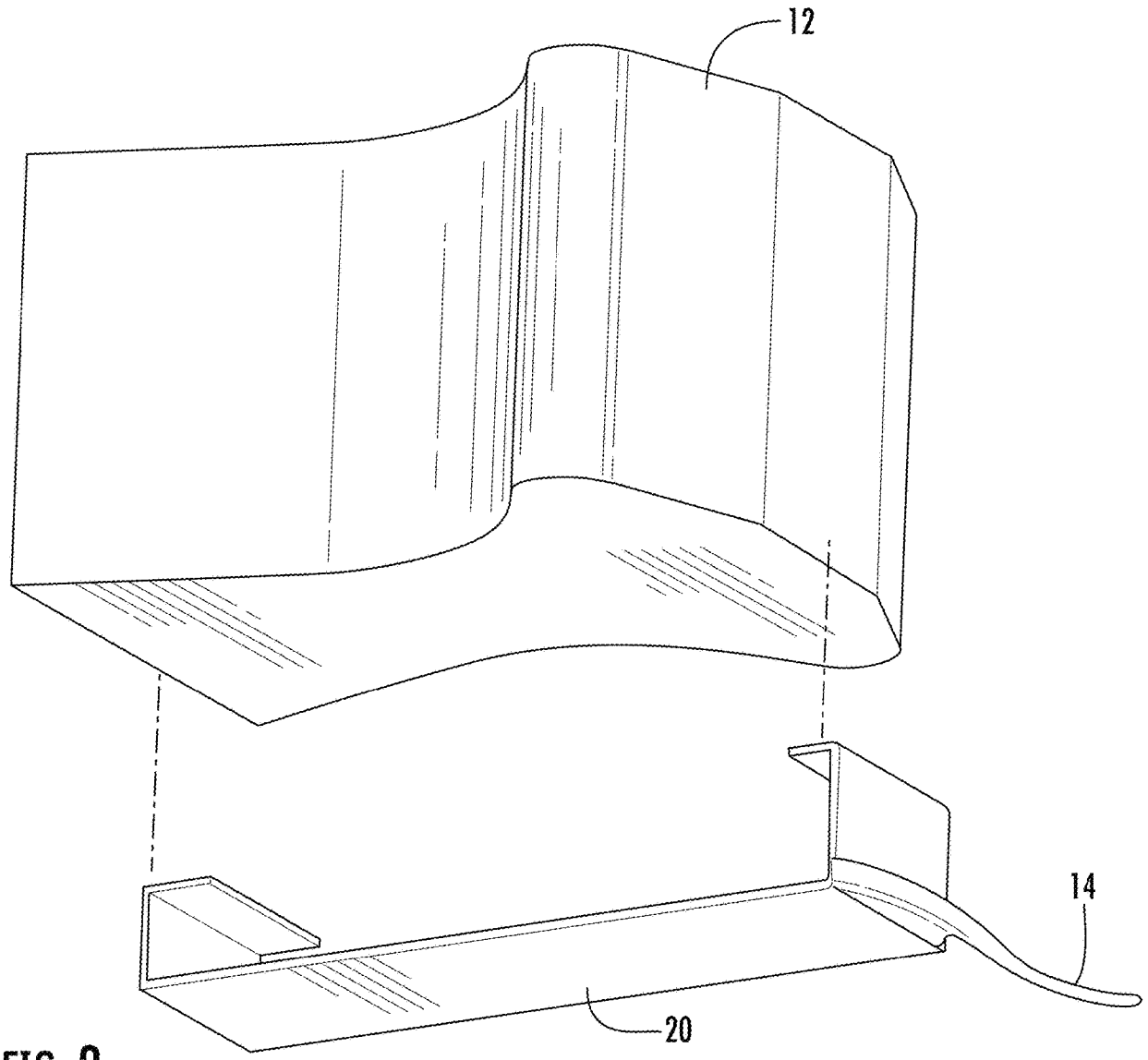
FIG. 2 is an exploded perspective view of one embodiment of a personal support apparatus outside of a fitted cover, where the support cushion is detached from the depressor tongue for illustration purposes.

Referring to FIG. 2, in a preferred embodiment, the depressor tongue 14 extends outwardly and downwardly from the bracket member 20, so that the bracket member 20 receives the support cushion 12, such that the bracket member 20 is removably attached to the support cushion 12. In one embodiment, the support cushion 12 may include a channel for receiving the bracket member 20. Other attachment means may be used to attach the bracket member 20 to the support cushion 12, including hook and loop fasteners, straps, zippers, snaps, or other suitable, commonly used attachment means, as will be understood by those skilled in the art. In an alternative embodiment, the bracket member 20 can be fixed to the support cushion or integrally molded to be one piece with the support cushion 12. It should be understood that the depressor tongue structure 14 may be attached to the support cushion 12 in other ways, without the necessity of the bracket member 20. For example, the depressor tongue structure 14 may include a generally straight arm that is inserted into an opening or internal channel defined within the support cushion 12. Any suitable method for attaching the depressor tongue structure 14 to the support cushion may be used, so long as the depressor tongue is oriented so that it creates the cavity 18 on the sleeping surface 10.

In another alternative embodiment, the depressor tongue structure 14 can be pivotally or hingedly attached to the bracket member 20 for changing the angle of the tongue(s) or for storage and transport when not in use, or and unfolded and locked or unlocked into place when in use. Additionally, the depressor tongue structure 14 may be formed into a telescoping configuration, so that it may be elongated for use and retracted when not in use, as desired. Alternatively, the depressor tongue 14 can be removable from and re-attachable to the bracket member 20, such as by having a threaded portion that screws into a recess in the bracket member 20, and allowing the depressor tongue 14 to be interchangeably replaced by varying sizes and shapes of other depressor tongues 14. Any number of fastening systems may be used to removably attach the depressor tongue 14 to the bracket member 20, whether using a threaded screw, a spring-loaded button, snaps, surrounding cases, or any other fastener that reliably keeps the depressor tongue 14 in place when in use. In this way, the user can choose different types and shapes of depressor tongues 14 that may be more suitable to the user's size, resting preferences, and sleeping surface materials.

Once the bracket member 20 is attached to the support cushion 12, a fitted cover 22 can be used to contain the bracket member 20 and support cushion 12, and the fitted cover 22 may define a hole through which the depressor tongue 14 extends outwardly therefrom. The cover 22 can be made of any material commonly used for pillowcases, such as cotton, synthetic fabric, a mixture, or a breathable, moisture-wicking fabric. The cover may be woven or non-woven. In an alternative embodiment, the depressor tongue structure 14 could also be secured directly to the cover 22, for example, by being placed into a sleeve of the cover, such that when the cover 22 is placed on the support cushion 12, the depressor tongue 14 is thereby secured to the support cushion 12. Furthermore, the cover 22 itself when placed on the support cushion 12 could serve to secure the depressor tongue 14.

The cover 22 can also be configured to have a pocket for receiving the protruding portion 16 of the depressor tongue 14, or it can contain an aperture 26 through which the protruding portion 16 of the depressor tongue 14 can extend. The cover 22 may also be configured to include a handle member.

In a preferred embodiment, the bracket member 20 and depressor tongue 14 are made of a rigid or semi-rigid material, which may include plastic, aluminum, fiberglass, carbon fiber, rubber, or any other material that can maintain its form and remain rigid enough to compress the sleeping surface 10 when the user is resting on the support cushion 12.

Figure 3:
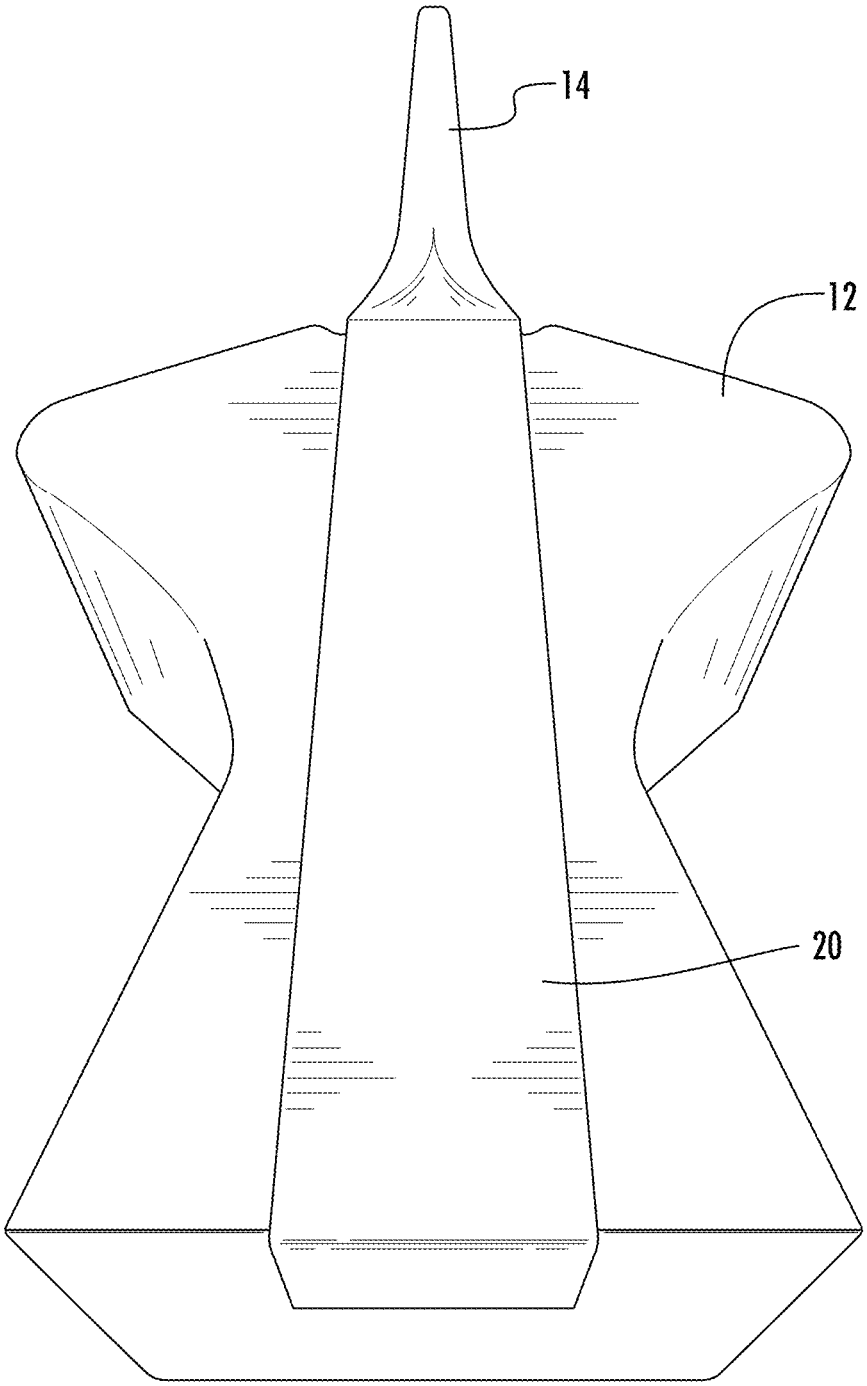
FIG. 3 is a bottom plan view of one embodiment of a personal support apparatus without a case, showing the depressor tongue attached according to an alternative embodiment.
Figure 4:
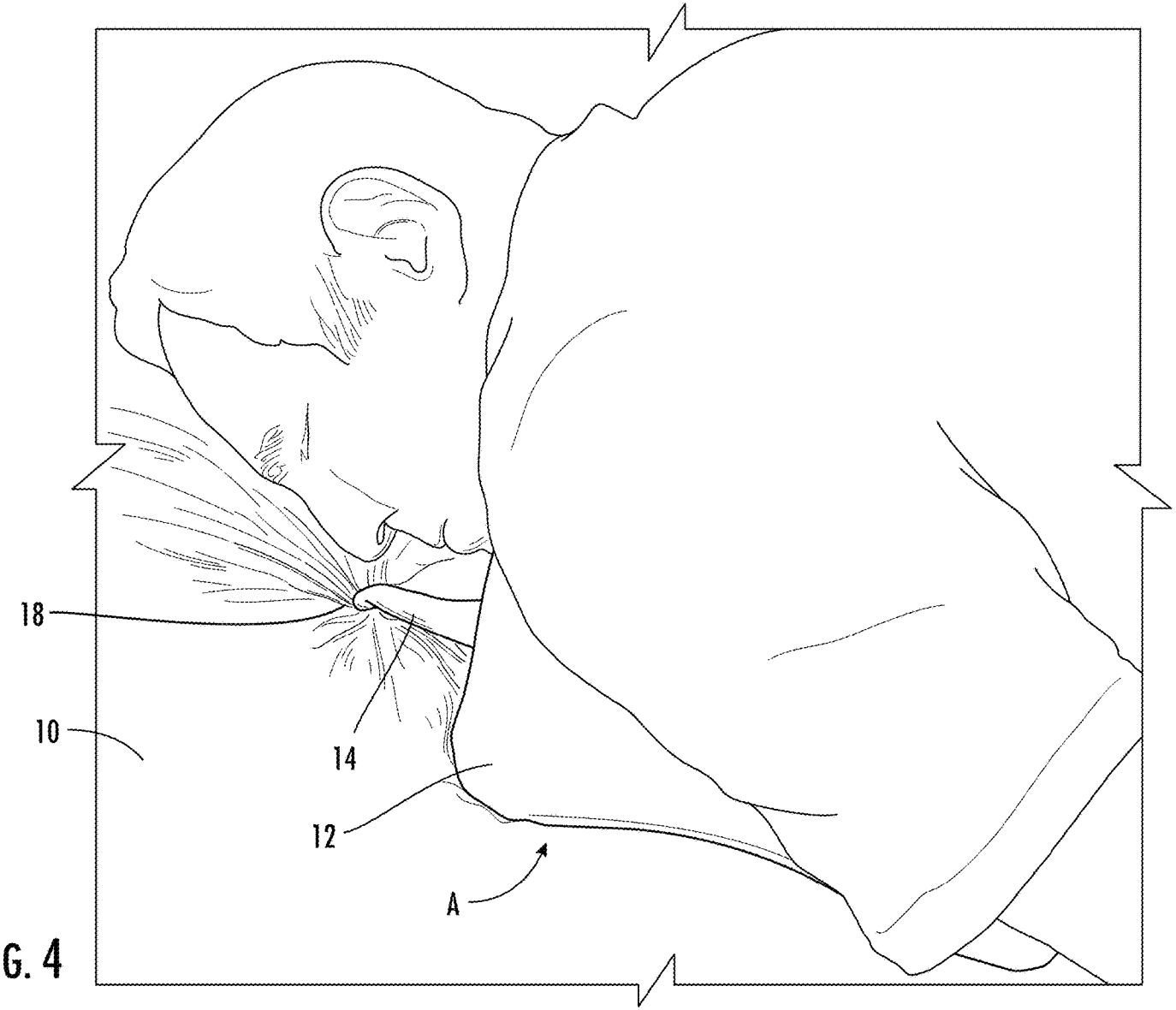
FIG. 4 is a perspective view of one embodiment of a personal support apparatus shown in use by a person lying in the prone position.

FIGS. 1-3 illustrate a depressor tongue 14 that is preferably a tapered conical or tongue shape and protruding generally from the support cushion for at least 3 inches, and preferably with a width at its midpoint generally between 0.5 and 4 inches, but with other dimensions still capable of accomplishing the objectives of the invention. It should be understood that different materials, shapes, and dimensions of the bracket member 20 and depressor tongue 14 can be employed and accomplish the same results, though it is desirable to choose shapes and materials that do not have sharp edges, interfere with the user's rest, or pose concerns of injuring the user. Other shapes could include an obelisk, rod, u-shaped arm, rectangle, or tail.

Figure 5:
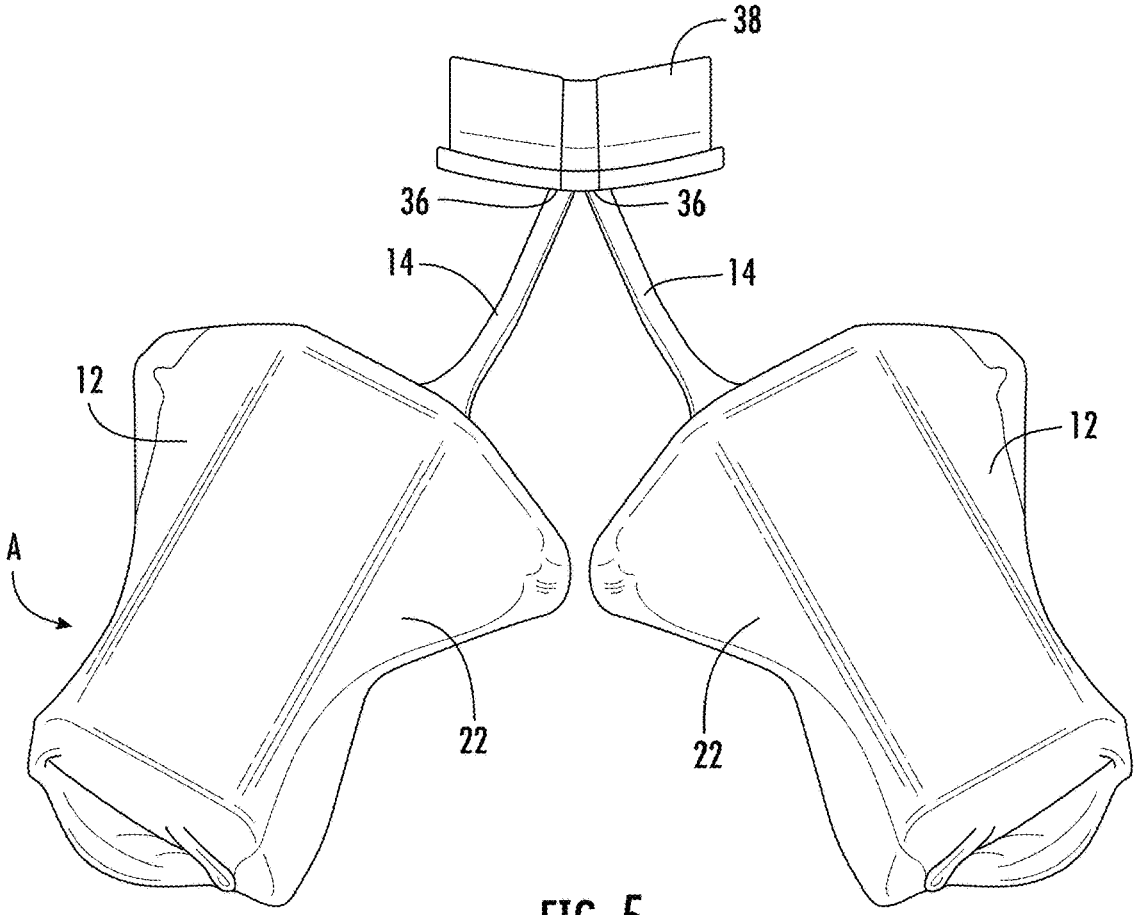
FIG. 5 is an elevated perspective view of one embodiment of a personal support apparatus with two support cushions according to an alternative embodiment.

FIG. 5 shows an alternative embodiment where the personal support pillow assembly A comprises two support cushions 12 spaced relatively evenly apart from one another for receiving a user's shoulders; at least one depression tongue 14 formed from a rigid or semi-rigid material and initially extending from each support cushion 12 at a downward angle relative to the sleeping surface 10, then extending outward or at an upward angle. The distal ends 36 of each depressor tongue 14 relative to the support cushions 12 are connected to a cradle 38 for receiving a user's forehead. In this way, when a user is in a prone position on the sleeping surface 10, with the user's shoulders resting on the support cushions 12 and the user's forehead resting on the cradle 38, the depressor tongues 14 press into the sleeping surface 10 to form a depression or cavity 18 in the sleeping surface 10, creating breathing space in the area of the user's mouth and nose. Other embodiments may employ two support cushions attached rigidly to a connecting tube or other shaped connector to which a single centrally located depressor tongue structure would extend at a downward angle relative to the sleeping surface then extending outward or at an upward angle to a cradle for receiving a user's forehead.

In an alternate embodiment of the two-cushion assembly, the apparatus includes a depressor tongue structure having a cradle attached to one end thereof, and a support bar that is attached to the other end of the depressor tongue. Two support cushions are attached to the support bar, so that one support cushion is attached at each end of the support bar, and so that the depressor tongue is attached to a center portion of the support bar. In this arrangement, the depressor tongue intersects with the support bar to form a T-shape.

Figure 6:
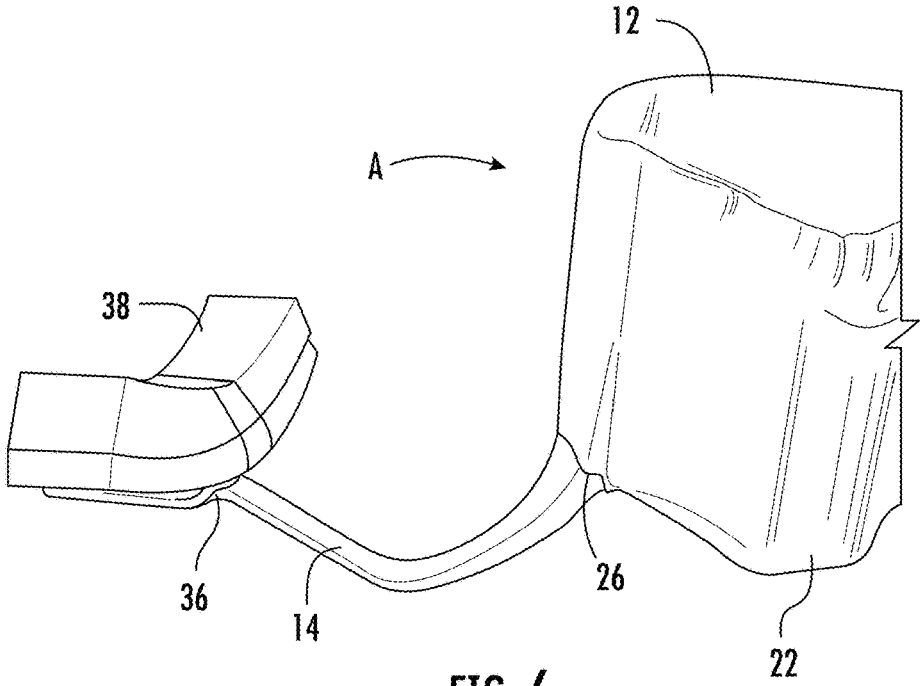
FIG. 6 is a perspective view of one embodiment of a personal support apparatus according to an alternative embodiment.

However, other embodiments may employ a cradle without needing two support cushions, and may be configured to receive other portions of a user's body, such as an arm or hand. As shown in FIG. 6, one such embodiment uses one support cushion 12 for receiving just one of a user's shoulders or upper body and has only one depressor tongue 14, which extends from the support cushion 12 at a downward angle relative to the sleeping surface 10, then extends at an upward angle. The distal end 36 of the depressor tongue 14 in this embodiment is connected to a cradle 38, which can be configured for receiving various parts of the user's body, such as a forehead or an arm or hand. This embodiment still accomplishes the objectives of the invention, such that when a user is resting the user's shoulder or upper body on the support cushion 12 and other portions of the user's body on the cradle 38, the pressure on the depressor tongue 14 causes the sleeping surface 10 to form a depression or cavity 18, again providing for breathing room in the area of the user's mouth and nose. Such an embodiment may be preferred by some users to an embodiment having two support cushions, as it may be smaller and also easier to use in a lateral recumbent position.

It is to be understood that the personal support apparatus may be modified or constructed in alternative embodiments. It may be fabricated to target a high-end consumer, or modified to adjust manufacturing costs and meet a price point best for mass-marketing.

While the preferred embodiment of the invention has been described using specific terms, such description is for illustrative purposed only, and it is to be understood that changes and variations may be made without departing from the spirit or scope of the following claims.

What is claimed is:

1. A personal support apparatus for use when resting on a sleeping surface, said personal support apparatus comprising:

a support cushion removably attached to a bracket member;

wherein said bracket member includes a depressor tongue that extends outwardly and away from said support cushion at a downward angle relative to the sleeping surface;

whereby said depressor tongue is adapted to cause a depression on the sleeping surface when a user is supported by said support cushion on said sleeping surface.

2. The personal support apparatus of claim 1, wherein the bracket member is fixed to said support cushion, or the bracket member is integrally molded in one piece with the support cushion.

3. The personal support apparatus of claim 2, further including multiple depressor tongues of different sizes that are configured to be interchangeably attached to said bracket member.

4. The personal support apparatus of claim 1, further comprising a cover into which the support cushion and depressor tongue may are configured to be securely fitted.

5. The personal support apparatus of claim 4, wherein said cover defines an aperture through which the depressor tongue may is configured to extend.

6. The personal support apparatus of claim 4, wherein the cover includes a handle member.

7. The personal support apparatus of claim 1, wherein said depressor tongue is pivotally attached to said bracket member.

8. The personal support apparatus of claim 1 wherein a cradle is attached to a distal end of said depressor tongue for receiving and supporting a portion of a body of the user.

9. The personal support apparatus of claim 1, where the support cushion is contoured in an hourglass shape with inward curved sidewalls.

10. The personal support apparatus of claim 1, wherein said depressor tongue is made from a rigid or semi-rigid material.

11. The personal support apparatus of claim 1, wherein the protruding portion of the depressor tongue extends from the support cushion at least 3 inches.

12. A personal support pillow assembly for use on a flexible sleeping surface comprising:

at least one support cushion; and at least one depressor tongue formed from a rigid or semi-rigid material and extending from said support cushion at a downward angle toward a sleeping surface;

wherein said depressor tongue engages with said sleeping surface to form a depression on the sleeping surface when a user is supported by said support cushion on the sleeping surface.

13. The personal support pillow assembly of claim 12, wherein said depressor tongue includes a cradle at a distal end thereof for receiving and supporting a portion of a body of the user.

14. A personal support pillow assembly for use when resting on a flexible sleeping surface comprising:

two support cushions spaced relatively evenly apart from one another for receiving a pair of shoulders of a user;

wherein each said support cushions is removably attached to a bracket member; said bracket members being operatively connected to a depressor tongue at a first end thereof; and a cradle attached to a second, distal end of said depressor tongue;

wherein when the user is in a prone position on the sleeping surface, with the pair of shoulders of the user resting on the support cushions on the sleeping surface and a forehead of the user resting on the cradle, the depressor tongues are forced into said sleeping surface to form a depression providing for breathing room in the area of a mouth and a nose of the user.

* * * * *